United States Patent [19]

Heavner

[11] 4,134,533

[45] Jan. 16, 1979

[54] STACKABLE CONTAINER

[75] Inventor: William D. Heavner, Clovis, Calif.

[73] Assignee: Container Corporation of America, Chicago, Ill.

[21] Appl. No.: 861,878

[22] Filed: Dec. 19, 1977

[51] Int. Cl.[2] ..... B65D 5/22

[52] U.S. Cl. ..... 229/34 R; 229/DIG. 11; 229/DIG. 4

[58] Field of Search ..... 229/4, 34 R

[56] References Cited

U.S. PATENT DOCUMENTS

| | | | |
|---|---|---|---|
| 2,721,689 | 10/1955 | Nye | 229/DIG. 11 |
| 2,893,621 | 7/1959 | Harmish et al. | 229/DIG. 11 |
| 3,015,431 | 1/1962 | Mulcoy | 229/DIG. 11 |
| 3,114,493 | 12/1963 | Dunkin | 229/DIG. 11 |
| 3,199,763 | 8/1965 | Anderson | 229/DIG. 4 |
| 3,792,809 | 2/1974 | Schneider | 229/DIG. 4 |
| 3,820,706 | 6/1974 | Gibson et al. | 229/34 R |

*Primary Examiner*—Davis T. Moorhead
*Attorney, Agent, or Firm*—Carpenter & Ostis

[57] ABSTRACT

A shipping container having stacking tabs projecting upwardly from certain walls thereof for receipt within openings in lower portions of similar containers.

5 Claims, 5 Drawing Figures

STACKABLE CONTAINER

SUMMARY OF THE INVENTION

This invention relates to paperboard shipping containers of the type commonly used for the packaging and transportation of produce and other merchandise.

It is desirable in using containers of this type to stack a plurality of containers vertically, and the concept of providing containers with stacking lugs is old in the art.

One of the problems that has arisen with containers of this type is that of aligning the stacking tabs of one container with the apertures in the lower portions of a container stacked above, especially when the apertures are at the extreme side or end edges of the container.

It is therefore an object of this invention to provide a shipping container formed of a unitary blank of foldable paperboard which has upwardly projecting stacking tabs and which has openings in the lower portions of certain walls of the container adapted to receive stacking tabs of a similar container.

A more specific object of the invention is to provide, in a container of the type described, apertures at the end walls of a container which are so formed as to facilitate aligning such apertures with stacking tabs of similar containers.

These and other objects of the invention will be apparent from an examination of the following description and drawings.

THE DRAWINGS

It will be understood that, for purposes for clarity, certain elements may have been intentionally omitted from certain views where they are believed to be illustrated to better advantage in other views.

THE DESCRIPTION

Figure 1:
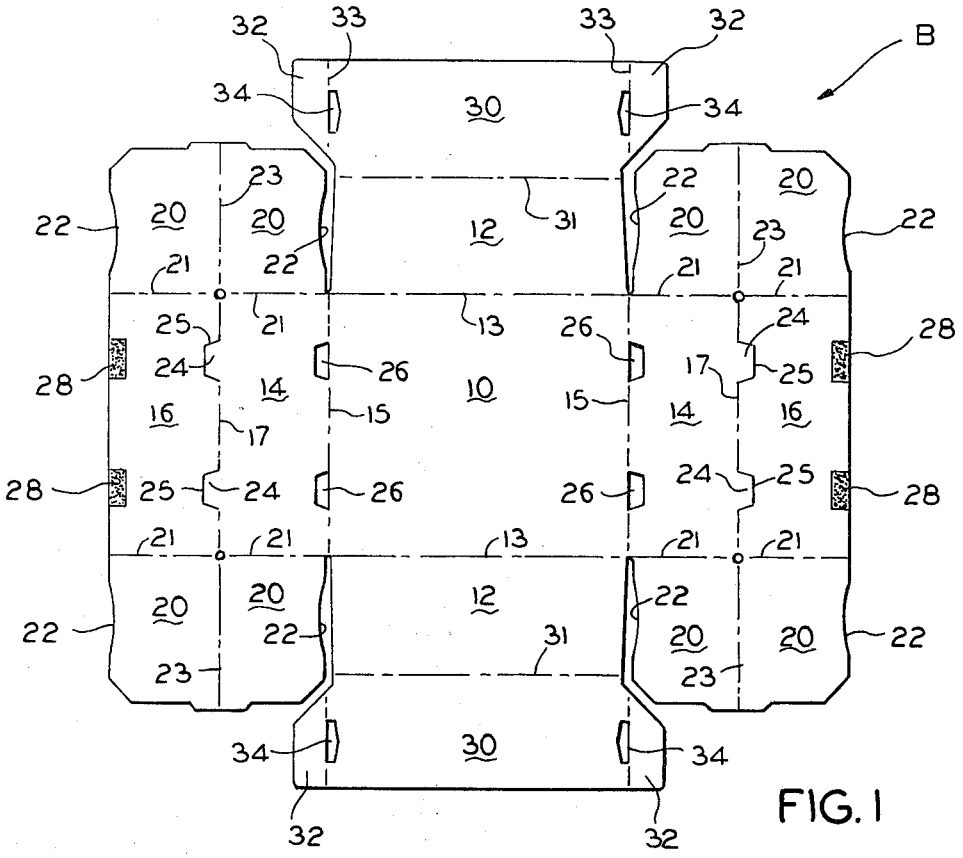
FIG. 1 is a plan view, as seen from the inside, of a blank of foldable paperboard from which the container illustrated in the other views may be formed.
Figure 3:
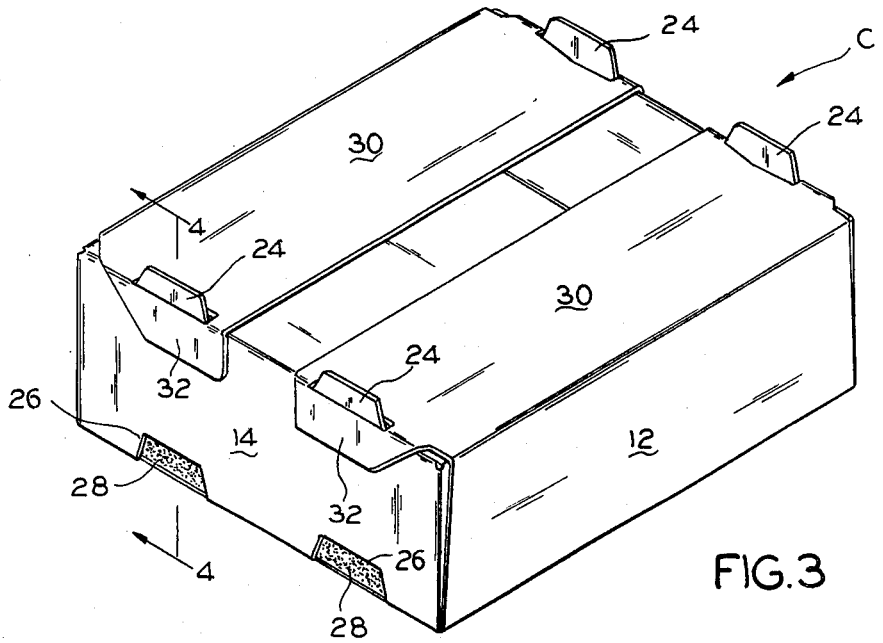
FIG. 3 is a perspective view of a container embodying features of the invention shown the completely erected and closed condition.

Referring now to the drawings for a better understanding of the invention, it will be seen that a shipping container indicated generally at C in FIG. 3 may be formed from a unitary blank of foldable paperboard indicated generally at B and illustrated in FIG. 1.

Figure 2:
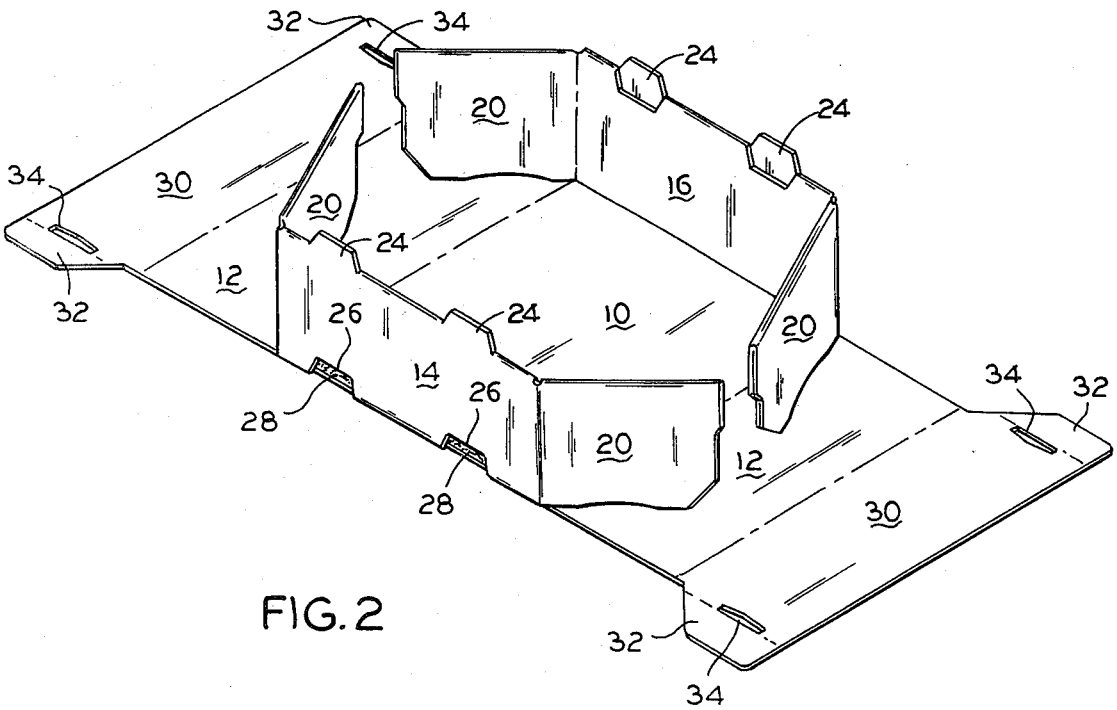
FIG. 2 is a perspective view of the structure illustrated in FIG. 1 shown in a partially erected condition.

As best seen in FIGS. 2 and 3, container C includes a preferably rectangular bottom wall 10 having opposed pairs of side and end walls joined thereto and upstanding therefrom to form a box-like structure. The side walls each include a pair of single side wall panels 12 foldably joined to opposite side edges of bottom wall 10 along fold lines 13.

The end walls each include an end wall outer panel 14 foldably joined at its lower edge along a fold line 15 to a related end edge of bottom wall 10 and an inner panel 16 foldably joined at its upper edge along a fold line 17 to the upper edge of outer side wall panel 14. Inner and outer end wall panels are folded about fold line 17 in face-to-face relation to present double ply end walls. Each end wall panel has a pair of connecting flaps 20 foldably joined along fold lines 21 to opposite sides thereof and each adjacent pair of connecting flaps 20 is foldably joined to each other along a fold line 23 which is aligned with related fold line 17. When the container is erected the connecting flaps are folded at right angles to the end walls and may be secured to adjacent portions of related side wall panels 12 in any desired manner, such as by gluing or stapling (not shown). Connecting flaps 20 may be provided with arcuate recesses 22 at their lower edges to minimize wipeoff of adhesive from other portions of the container during assembly.

Each of the end wall outer panels 14 is provided with one or more stacking tabs 24 which are formed from material cut from related end wall inner panel 16 along cut lines 25. As best seen in FIGS. 2 and 3, stacking tabs 24 are disposed to project upwardly from the end walls when the container is in erected condition.

Each of the end wall outer panels 14 is provided at its lower edge with one or more openings 26 which are disposed immediately adjacent the related fold line 15 which joins the end wall outer panel 14 to bottom wall 10. Also, each of the end wall inner panels 16 is provided with one or more depressed areas 28 which are formed preferably by crushing the paperboard material, which may be corrugated paperboard, and the depressed areas 28 are located immediately above the lower edge of end wall inner panel 16 so as to be in alignment with related openings 26 in the adjacent end wall outer panel 14, as best illustrated in FIGS. 2 and 3.

Figure 4:
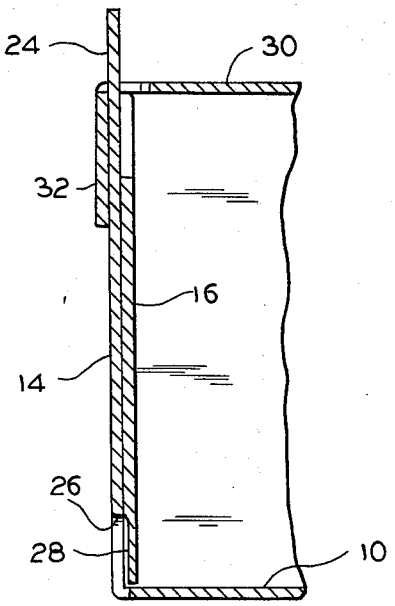
FIG. 4 is a fragmentary, longitudinal, vertical section taken on line 4—4 of FIG. 3.
Figure 5:
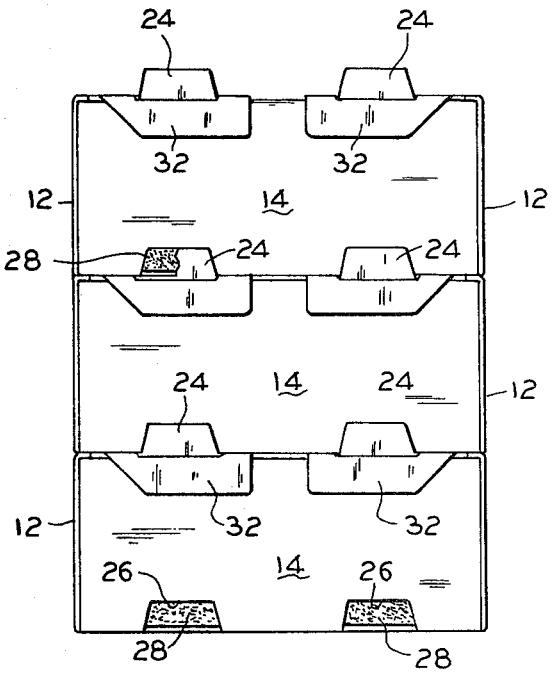
FIG. 5 is a fragmentary end elevation illustrating the manner in which a plurality of containers of the type illustrated in FIG. 3 can be stacked one atop the other.

Thus it will be understood that when a plurality of similar containers embodying the invention are stacked vertically one atop the other as shown in FIG. 5, the stacking tabs 24 of a lower container will be received within the openings 26 and 28 in the upper container. As best seen in FIG. 4, the depressed areas 28 in each end wall inner panel provide additional clearance which facilitates the entry of stacking tabs into the related openings 26. This is important, because when containers of merchandise such as produce are stacked in the fields, it is essential that there be a clear and accurate interlocking connection between the containers to prevent the contents from falling, thereby causing damage to the goods packaged therein.

Additionally, the container may be provided with a cover or partial cover in the form of a pair of cover panels 30 which are foldably joined along fold lines 31 to the upper edges of opposite side wall panels 12. The cover panels are adapted to be folded inwardly at right angles to the side walls with their end edges supported by the opposite end walls of the container. Each of the cover panels 30 may be provided at opposite ends thereof with a relatively small depending ear or flap 32 which is foldably joined to the cover panel along fold line 33. The ears 32 prevent the cover panel from being depressed into the container. Also, each of the cover panels may be provided at opposite ends thereof in alignment with fold lines 33, a pair of openings 34 adapted to permit the related stacking tabs 24 to project through the cover panel and into the openings of a related container.

I claim:

1. In a stackable container formed of a unitary blank of foldable paperboard, the combination of:

(a) a bottom wall;

(b) pairs of opposed side and end walls foldably joined to and upstanding from opposed side and end edges of said bottom wall;

(c) said end walls each including an outer panel joined at its lower edge to said bottom wall and an inner panel joined at its upper edge to the upper edge of said outer panel;

(d) said end walls having stacking tabs projecting upwardly therefrom adapted to be received within related recesses in the lower portion of a similar container to prevent lateral movement therebetween when containers are stacked;

(e) each of said recesses including an opening extending completely through an end wall outer panel and a depressed area of reduced thickness in the related end wall inner panel aligned with said opening;

(f) means for joining adjacent ends of side and end walls at the corners of the container.

2. A container according to claim 1, wherein the means for joining side and end walls at each corner of the container include a connecting flap foldably joined to one of said side and end walls and secured to the other of said side and end walls.

3. A container according to claim 1, and including cover panels foldably joined to upper edges of respective side walls and adapted to be folded inwardly and normally thereto to close at least a portion of the container.

4. A container according to claim 3, wherein said cover panels each include a pair of ears foldably joined to opposite end edges thereof and folded downwardly to overly adjacent areas of related end walls.

5. A container according to claim 3, wherein each of said cover panels includes openings at opposite ends thereof for receiving stacking tabs of related end walls.

* * * * *